US008939324B2

(12) United States Patent
Azodi et al.

(10) Patent No.: US 8,939,324 B2
(45) Date of Patent: Jan. 27, 2015

(54) FIZZ RETAINING DEVICE FOR BEVERAGE CONTAINERS

(76) Inventors: Kazem Azodi, Houston, TX (US); Ghasem Azodi, Houston, TX (US)

( * ) Notice: Subject to any disclaimer, the term of this patent is extended or adjusted under 35 U.S.C. 154(b) by 890 days.

(21) Appl. No.: 11/481,125

(22) Filed: Jul. 5, 2006

(65) Prior Publication Data

US 2009/0008357 A1 Jan. 8, 2009

(51) Int. Cl.

| | |
|---|---|
| ***B65D 41/00*** | (2006.01) |
| ***B67B 7/00*** | (2006.01) |
| ***B67D 3/00*** | (2006.01) |
| ***F25D 23/12*** | (2006.01) |
| *B65B 31/00* | (2006.01) |

(52) U.S. Cl.

CPC ..... *B67B 7/26* (2013.01); *B67D 3/0009* (2013.01); *B67D 3/0032* (2013.01); *F25D 23/126* (2013.01); *B65B 31/00* (2013.01); *F25D 2331/803* (2013.01)

USPC .... 222/153.14; 222/81; 222/566; 222/153.04

(58) Field of Classification Search

USPC ..... 222/83, 399, 400.7, 468–474, 323, 152, 222/81, 153.14, 153.04, 566

See application file for complete search history.

(56) References Cited

U.S. PATENT DOCUMENTS

| | | | | | |
|---|---|---|---|---|---|
| 554,780 | A | * | 2/1896 | Hulings | 222/324 |
| 2,051,981 | A | * | 8/1936 | Bowman | 222/399 |
| 2,388,026 | A | * | 10/1945 | Ward | 222/399 |
| 2,595,317 | A | * | 5/1952 | White, Jr. | 222/80 |
| 2,705,578 | A | * | 4/1955 | Burns | 222/5 |
| 2,723,161 | A | * | 11/1955 | Covington | 222/386.5 |
| 2,753,080 | A | * | 7/1956 | Bartlett | 222/82 |
| 2,820,578 | A | * | 1/1958 | Dickman | 222/323 |
| 3,105,619 | A | * | 10/1963 | Rohrmuller | 222/209 |
| 3,113,725 | A | * | 12/1963 | Packard et al. | |
| 3,270,919 | A | * | 9/1966 | Frangos et al. | 222/82 |
| 3,877,614 | A | * | 4/1975 | Murphy | 222/209 |
| 3,883,043 | A | * | 5/1975 | Lane | 222/82 |
| 3,980,209 | A | * | 9/1976 | Collar | 222/323 |
| 3,985,268 | A | * | 10/1976 | Wood | 222/108 |
| 4,043,341 | A | * | 8/1977 | Tromovitch | 606/22 |
| 4,222,525 | A | * | 9/1980 | Hildebrandt | 239/343 |
| 4,392,578 | A | * | 7/1983 | Fipp et al. | 215/231 |
| 4,595,121 | A | * | 6/1986 | Schultz | 222/1 |
| 4,674,662 | A | * | 6/1987 | Bergstrom et al. | 222/399 |
| 4,763,818 | A | * | 8/1988 | Stefano et al. | 222/209 |
| 4,778,081 | A | * | 10/1988 | Vaughan | 222/83.5 |
| 4,832,231 | A | * | 5/1989 | Kolody | 222/144.5 |
| 4,934,543 | A | * | 6/1990 | Schmidt | 215/228 |
| 4,984,711 | A | * | 1/1991 | Ellis | 222/83 |

(Continued)

*Primary Examiner* — Donnell Long
(74) *Attorney, Agent, or Firm* — Delphine James

(57) ABSTRACT

A carbonation retaining closure assembly device for beverage containers. The device comprising a cap member manufactured to seal and adapted to engage with the mouth of the beverage container. An inner groove surrounds the outer peripheral edge of the cap member forming a stud within the center of the cap member. The stud has a threaded outer wall. A connector member has an internal bore dimensioned to accommodate the length and circumference of the stud. The bore has means for securely engaging upon the outer wall of the stud. A cutting means is internally mounted within the top layer of the bore wherein a slit is punctured within the outer wall as the connector member is engaged upon the stud. A dispensing mechanism is disposed upon the top of the connector member for dispensing the beverage through the slit such that the carbonation level in the beverage container is retained.

10 Claims, 10 Drawing Sheets

(56) References Cited

U.S. PATENT DOCUMENTS

| | | | | | |
|---|---|---|---|---|---|
| 4,995,534 | A | * | 2/1991 | Norman | 215/5 |
| 5,020,395 | A | * | 6/1991 | Mackey | 81/3.2 |
| 5,329,975 | A | * | 7/1994 | Heitel | 141/19 |
| 5,395,012 | A | * | 3/1995 | Grill et al. | 222/4 |
| 5,544,670 | A | * | 8/1996 | Phillips et al. | 137/224 |
| 5,772,491 | A | * | 6/1998 | Watkins | 446/475 |
| 5,944,224 | A | * | 8/1999 | Hodge et al. | 222/131 |
| 6,220,274 | B1 | * | 4/2001 | Wang | 137/231 |
| 6,273,861 | B1 | * | 8/2001 | Bates et al. | 600/567 |
| 6,364,176 | B1 | * | 4/2002 | Kilian | 222/468 |
| 6,471,390 | B1 | * | 10/2002 | Cuthbertson et al. | 366/101 |
| 7,044,404 | B1 | * | 5/2006 | Kricheldorf | 239/525 |
| 7,114,634 | B2 | * | 10/2006 | Azodi | 222/83 |
| 7,131,558 | B2 | * | 11/2006 | de la Guardia | 222/209 |
| 2004/0178220 | A1 | * | 9/2004 | Smith | 222/83 |

* cited by examiner

FIZZ RETAINING DEVICE FOR BEVERAGE CONTAINERS

BACKGROUND

The present invention relates to closure devices for carbonated beverage containers. The retention of the carbonation of a beverage after the container is initially open has been a problem recognized in the prior art. After the container is initially unsealed, the carbonated beverage immediately begins to loose its carbonation. Over time the beverage becomes flat even though the cap is utilized to reseal to the container. The carbonation continues to escape from the liquid into the interior of the container above the liquid.

A patent search was done and the following U.S. patent Nos. were found: U.S. Pat. No. 4,723,670 to Robinson et al which provides a hand-operated pump combined with a closure cap for sealing and pressuring the open space within a carbonated beverage container, U.S. Pat. No. 5,031,785 to Lemme which provides a combination pressure and vacuum pump for food or drink, and U.S. Pat. No. 4,899,896 to Metzger which provides a cap adapted for use in pressurizing the interior of a container for carbonated beverages.

The above mentioned patents disclose a device to re-pressurize the container to retain the carbonation within the beverage container once the container is opened. Additionally, the patents found from the search performed did not disclose a structure similar to the applicant's structure to be described herein.

SUMMARY

The object of the present invention is to provide an improved device for retaining carbonation inside beverage containers after opened for use. The present invention provides an assembly for a closure device for carbonated beverages. The device comprising a cap member manufactured to seal and adapted to engage with the mouth of the beverage container. An inner groove surrounds the outer peripheral edge of the cap member forming a stud within the center of the cap member. The stud has a threaded outer wall. A connector member has an internal bore dimensioned to accommodate the length and circumference of the stud. The bore has means for securely engaging upon the outer wall of the stud. A cutting means is internally mounted within the top layer of the bore wherein a slit is punctured within the outer wall as the connector member is engaged upon the stud. A handle with a CO2 container contained therein is operationally attached to connector member.

The device further includes a dispensing mechanism in the form of a pouring spout situated upon the connector member. A lever with an attached handle can be removably connected to the pouring spout to assist the user in the dispensing process. The dispensing mechanism can be configured to dispense from a plurality of carbonated beverage containers. In addition, an alternative form of the dispensing mechanism can be incorporated into a refrigerator. In alternative embodiments connector member is permanently affixed to a conventional cap member. In yet another alternative embodiment, connector member 35 is removable mounted upon the cap of bottle and dispensing mechanism is removably connected to the top of connector member.

The present invention consists of the arrangement of the parts hereinafter more fully describe in the specification, illustrated in the accompanying drawings and more particularly pointed out in the appended claims. It is understood that changes maybe made in form, size proportion and minor details of construction without departing from the spirit or sacrificing any of the advantages of the invention.

BRIEF DESCRIPTION OF DRAWING(S)

Figure 10:
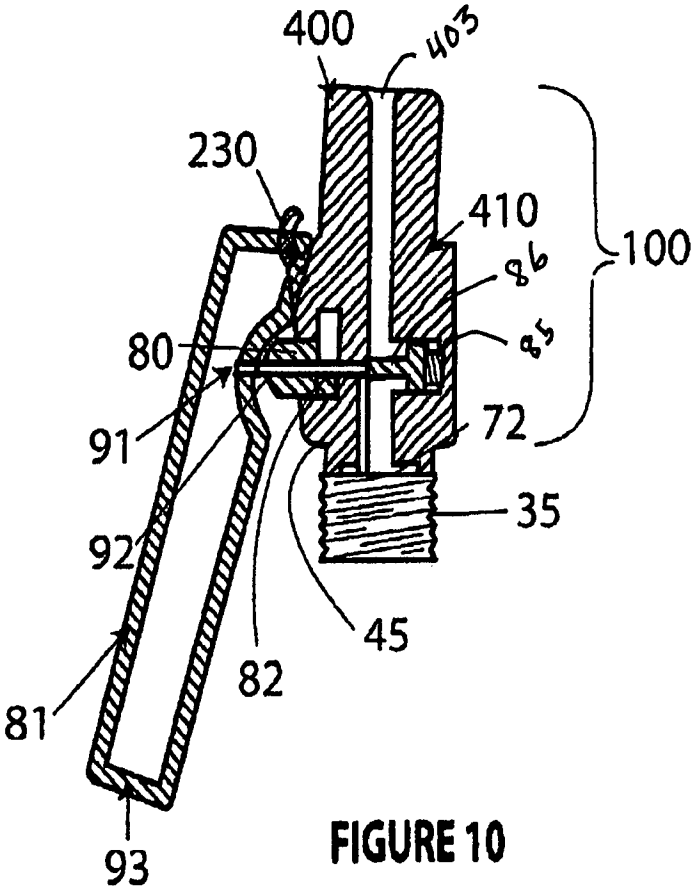
FIG. 10 is an alternative embodiment of the present invention, a beverage retaining device.

FIG. 10 A is another alternative embodiment of the present invention, a beverage retaining device.

Figure 11:
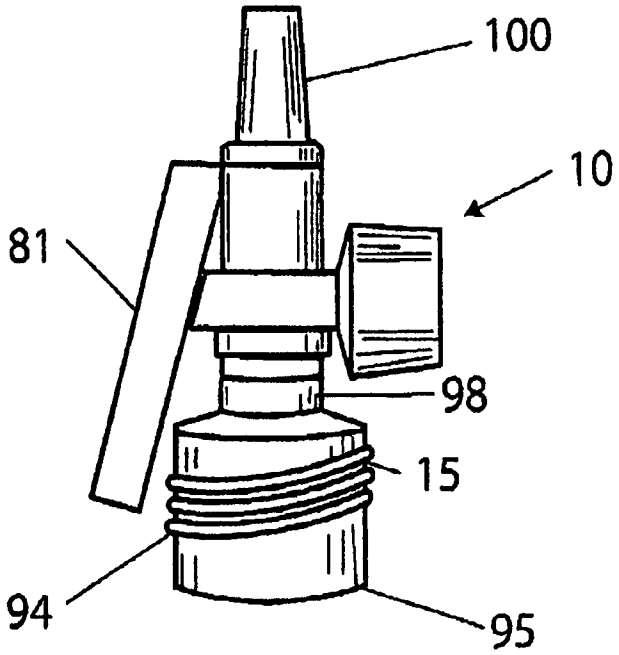

FIG. 11 is an alternative embodiment of the present invention, a beverage retaining device.

Figure 11A:
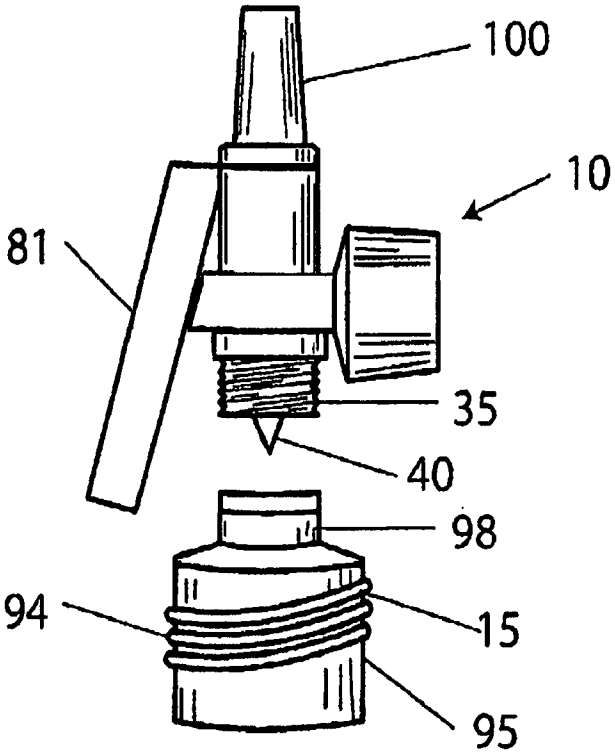

FIG. 11A illustrates the beverage retaining device disconnected from cap member.

DETAILED SPECIFICATION

Figure 1:
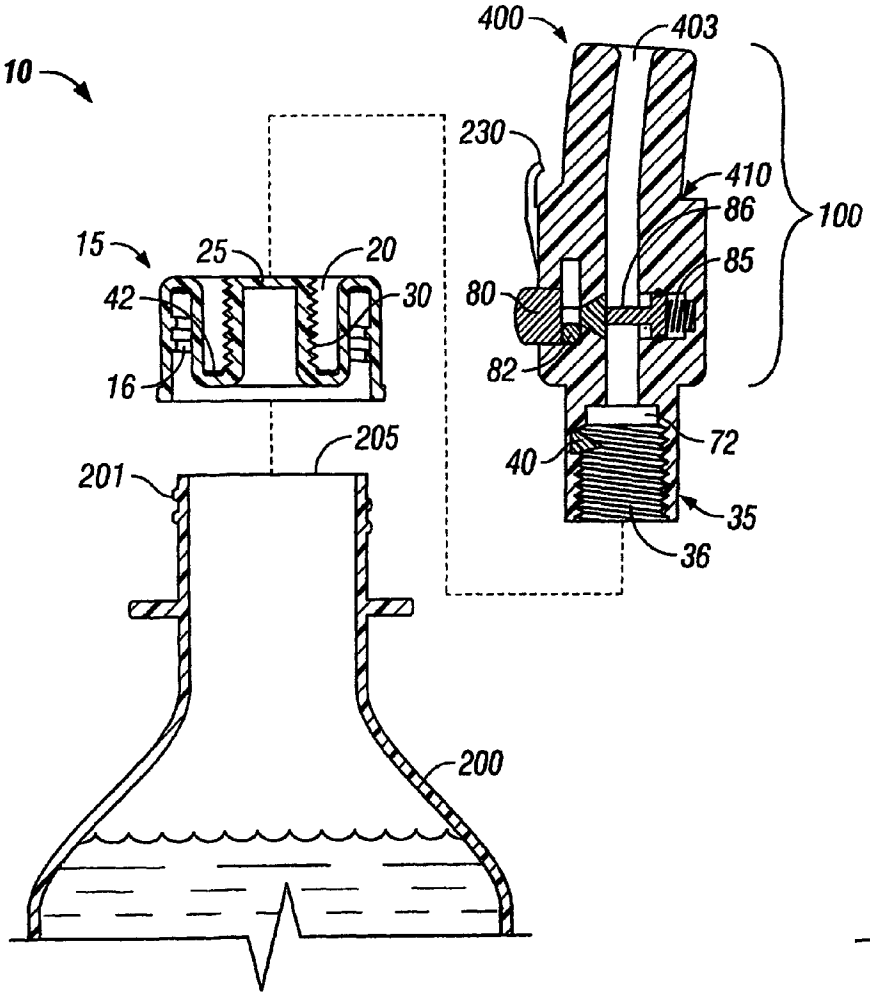
FIG. 1 is a cross-sectional side view of each part of the device disconnected from the beverage container.

Referring to FIG. 1, there is illustrated one embodiment of the different components of the present invention, a closure device (10) for a beverage container (200). The main components of device (10) include cap member (15), connector member (35), and dispensing mechanism (100). For illustration, in FIG. 1, the main components of the closure device are disconnected.

Figure 2:
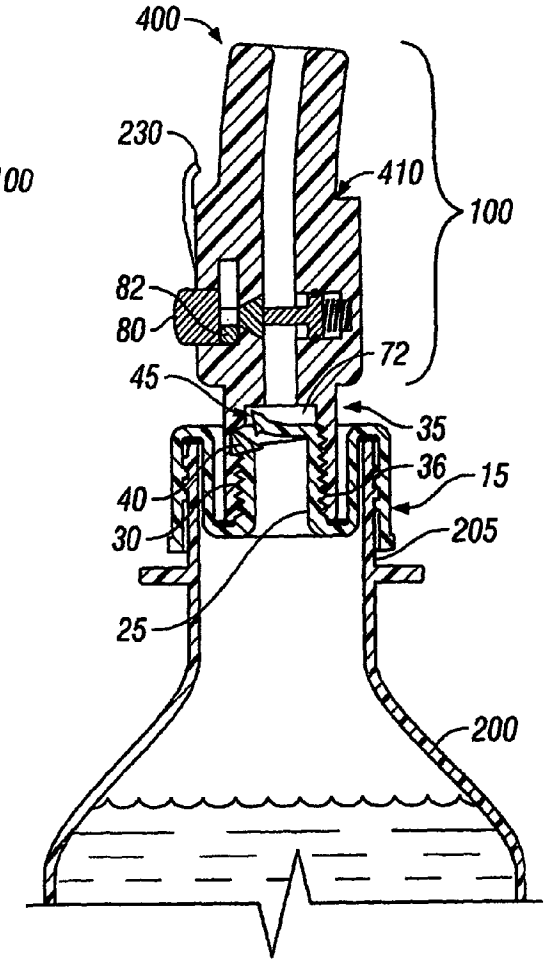
FIG. 2 is a cross-sectional side view of the device connected to the beverage container.

As shown, cap member (15) has a threaded interior wall (16) adapted to engage the mouth (201) of the beverage container (200). As shown in FIG. 2, cap member (15) has interior threading which is manufactured to engage with and seal the conventional outer threading of the mouth (201) of the container (200). After the carbonated beverage is stored within container (200), cap member (15) is manufacturally sealed upon the mouth (201) of container (200) in such a manner as to maintain the required carbon dioxide pressure level within the container (200).

As depicted in FIG. 1, an inner groove (20) surrounds the outer peripheral edge of the cap member (15) forming a stud (25) within the center of the cap member (15). Stud (25) has a threaded outer wall (30) for engagement with connector member (35). The height and length of stud (25) can vary depending upon manufacturer design requirements. The illustrated embodiment further comprises connector member (35) having an internal bore (36) dimensioned to accommodate the length and the circumference of the stud (25). Bore (36) has means for circumferentially engaging the threaded outer wall (30) of stud (25).

Cap member (15) can further include sealing means (42). As shown, sealing means (42) can be an integral washer circumferentially surrounding the bottom of stud (25).

As depicted in FIG. 1, internally disposed within the top layer of bore (35) is cutting means (40). As depicted, cutting means (40) is a small triangular shape blade permanently mounted within the upper layer of bore (36). The blade extends laterally outward from the inner wall of bore (36). The blade can made of steel or another suitable material.

As shown in FIG. 2, in use, as the connector member (35) is engaged upon stud (25), a slit (45) is punctured into the outer wall of stud (25). Internal bore (36) is securely threaded onto the outer wall (30) of stud (25). Upon the final turn of threading bore (36) upon stud (25), cutting means (40) punctures a slit (45) in the outer wall of stud (25). Slit (45) provides an opening leading into outlet port (72) formed at the upper end of connector member (35). Outlet port (72) provides the means for the dispensing of the beverage from the container (200). In this embodiment, throughout the dispensing process, cap member (15) remains sealed and is never disengaged from the mouth of container (200).

Dispensing mechanism (100) is operationally connected to the top of the connector member (35). As a portion of the beverage is removed from the container through dispensing mechanism (100), the original carbonation level in the beverage container is always retained. The major advantage of the present invention is that the length of the storage time of the remaining portion of the beverage within the container does not affect the carbonation level. With the present invention, the original carbonation level is retained until the last drop of beverage is dispensed.

Referring to FIG. 1, dispensing mechanism (100) is a pouring spout (400) integrally formed upon the upper outlet port (72) of connector member (35). Pouring spout (400) extends vertically upward from connector member (35) and includes a cylindrical shape bore (403) extending upward from outlet port (72). In the illustrated embodiment, pouring spout (400) has a stepped portion (410) with a slightly smaller diameter. A valve (85) is operationally coupled to outlet port (72). Valve (85) includes a hand controlled button mechanism (80) operationally coupled to a moveable valve element (86) for opening and closing the outlet port (72) for dispensing beverage from container (200).

Referring to FIG. 1, to prevent the operation of button mechanism (80) while container (200) is in an upright storage position, locking mechanism (82) is coupled to button mechanism (80). In this embodiment locking mechanism (82) includes a groove is formed within the pouring spout (400) lying along the backside of button mechanism (80). Locking mechanism (82) further includes a ball slidably engaged within the groove. While the container (200) is in an upright storage position, the ball remains positioned behind the button mechanism (80) preventing the depression of button mechanism (80). However, when the container (200) is placed in a pouring position, the ball travels down the groove to allow the depression of button mechanism (80). Here, locking mechanism (82) provides the advantage of preventing the escape of carbonation from the container while the container is in an upright storage position. Thus, the original carbonation pressure is never loss from the container due to accidental depression of button mechanism (80).

As shown in FIG. 10, in an alternative embodiment, handle 81 is operationally coupled to connector member 35. Handle 81 contains a CO2 container integrally formed and contained therein. When handle 81 is depressed CO2 is released through release spout 91 into passageway 92 into connector member 35. As depicted passageway 92 extends through button 80 and extends linearly downward through the lower portion of dispenser mechanism 100 and into connector member 35. The release of CO2 into bottle 200 keeps the beverage contained in bottle 200 through connector member 35 continuously carbonated. Simultaneously with the depression of handle 81, beverage from bottle 200 is dispensed through spout 400. Additionally, container 81 has an insertion spout 93 for recharging CO2 container contained therein.

Figure 10A:
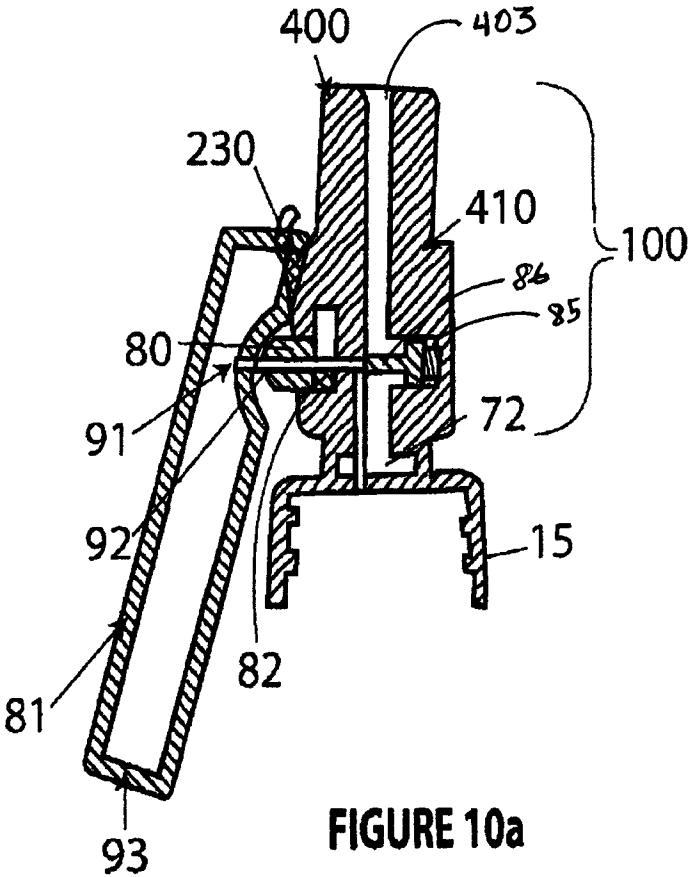

Referring to FIG. 10A, there is shown an alternative embodiment of the present invention. As shown, dispensing mechanism 100 is permanently affixed to a conventional cap member (15). To prevent the operation of button mechanism (80) while container (200) is in an upright storage position, locking mechanism (82) is coupled to button mechanism (80). In this embodiment locking mechanism (82) includes a groove is formed within the pouring spout (400) lying along the backside of button mechanism (80). Locking mechanism (82) further includes a ball slidably engaged within the groove. While the container (200) is in an upright storage position, the ball remains positioned behind the button mechanism (80) preventing the depression of button mechanism (80). However, when the container (200) is placed in a pouring position, the ball travels down the groove to allow the depression of button mechanism (80). Here, locking mechanism (82) provides the advantage of preventing the escape of carbonation from the container while the container is in an upright storage position. Thus, the original carbonation pressure is never loss from the container due to accidental depression of button mechanism (80).

As shown in FIG. 10A, in an alternative embodiment, handle 81 is operationally coupled to dispenser 100. Handle 81 contains a CO2 container therein. When handle 81 is depressed CO2 is released through release spout 91 into passageway 92 into the opening of bottle 200. As depicted passageway 92 extends through button 80 and extends linearly downward through the lower portion of dispenser mechanism 100 and into cap member 15. The release of CO2 into bottle 200 keeps the beverage contained in bottle 200 continuously carbonated. Simultaneously with the depression of handle 81, beverage is dispensed through spout 400. Additionally, container 81 has an insertion spout 93 for recharging CO2 container therein.

Referring to FIGS. 11 and 11A, there is illustrated an alternative embodiment of the different components of the present invention, a closure device (10) for a beverage container (200). The main components of device (10) include cap member (15), connector member (35), and dispensing mechanism (100). For illustration, in FIG. 11, the main components of the closure device are disconnected.

As shown, cap member (15) is configured and dimensioned to fit and seal upon a conventional cap securely sealed upon a bottle (not shown). The pair of opposing grip members 94 and 95 is used to release cap member 15 from the cap of a bottle. Cap 15 has internal securing means which are adapted to engage with the cap of a bottle (100). The upper portion 98 of cap member 15 has a smaller diameter than cap member 15. As depicted in FIG. 11, connector member 35 is affixed to the bottom of dispensing mechanism 100. In the preferred embodiment, connector member 35 is affixed with external threads thereto. These external threads are adapted to engage with the top portion of cap member 15 as depicted in FIG. 11. As depicted, cutting means (40) is a small triangular shape blade permanently mounted underneath connector member 35.

As shown in FIG. 2, in use, as the connector member (35) is engaged upon the top portion of cap member 35. Cutting means (40) punctures a slit (45) into the top of the cap upon bottle 200 (not shown).

Dispensing mechanism (100) is operationally connected to the top of the connector member (35). As a portion of the beverage is removed from the container through dispensing mechanism (100), the original carbonation level in the beverage container is always retained. The major advantage of the present invention is that the length of the storage time of the remaining portion of the beverage within the container does not affect the carbonation level. With the present invention, the original carbonation level is retained until the last drop of beverage is dispensed.

Referring to FIG. 11, dispensing mechanism (100) is a pouring spout (400) integrally formed upon the upper outlet port (72) of connector member (35). Pouring spout (400) extends vertically upward from connector member (35) and includes a cylindrical shape bore (403) extending upward from outlet port (72). In the illustrated embodiment, pouring spout (400) has a stepped portion (410) with a slightly smaller diameter. A valve (85) is operationally coupled to outlet port (72). Valve (85) includes a hand controlled button mechanism (80) operationally coupled to a moveable valve element (86) for opening and closing the outlet port (72) for dispensing beverage from container (200).

Referring to FIG. 11, to prevent the operation of button mechanism (80) while container (200) is in an upright storage position, locking mechanism (82) is coupled to button mechanism (80). In this embodiment locking mechanism (82) includes a groove is formed within the pouring spout (400) lying along the backside of button mechanism (80). Locking mechanism (82) further includes a ball slidably engaged within the groove. While the container (200) is in an upright storage position, the ball remains positioned behind the button mechanism (80) preventing the depression of button mechanism (80). However, when the container (200) is placed in a pouring position, the ball travels down the groove to allow the depression of button mechanism (80). Here, locking mechanism (82) provides the advantage of preventing the escape of carbonation from the container while the container is in an upright storage position. Thus, the original carbonation pressure is never loss from the container due to accidental depression of button mechanism (80).

As shown in FIGS. 11 and 11A, in an alternative embodiment, handle 81 is operationally coupled to dispenser mechanism 100. Handle 81 contains a CO2 container therein. When handle 81 is depressed CO2 is released through release spout 91 into passageway 92 into the opening of bottle 200. As depicted passageway 92 extends through button 80 and extends linearly downward through the lower portion of dispenser mechanism 100 and into cap member 15. The release of CO2 into bottle 200 keeps the beverage contained in bottle 200 continuously carbonated. Simultaneously with the depression of handle 81, beverage from bottle 200 is dispensed through spout 400. Additionally, container 81 has an insertion spout 93 for recharging CO2 container therein.

Figure 3:
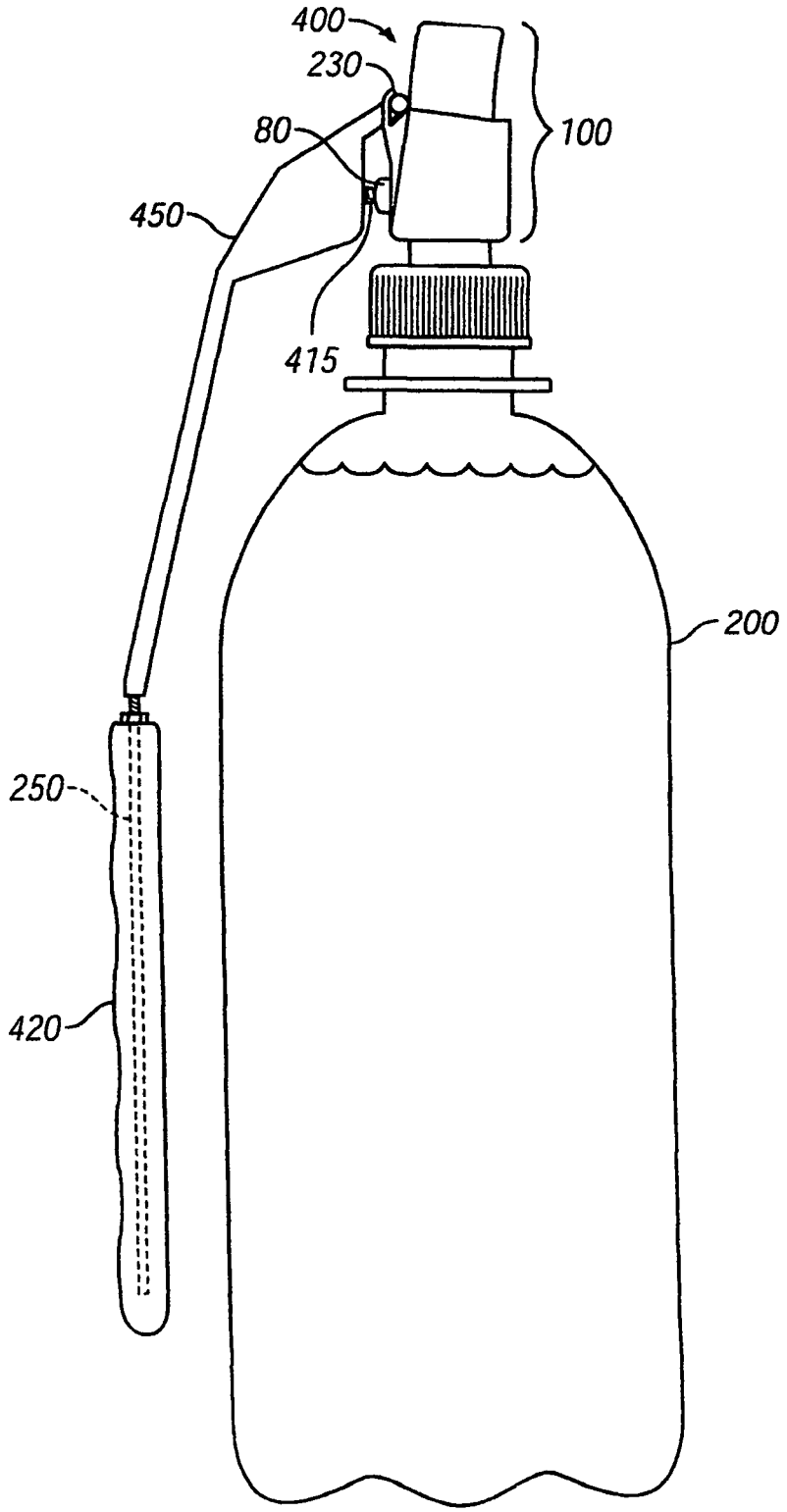
FIG. 3 is a front view of the device connected to the beverage container with the addition of a handle.

Referring to FIG. 3, dispensing mechanism (100) can further include a lever (450) to assist in dispensing the beverage from container (200). Lever (450) is externally mounted parallel to the upper most section of pouring spout (400) above button mechanism (80). Lever (450) is aligned adjacent to and parallel with the pouring spout (400).

Figure 4:
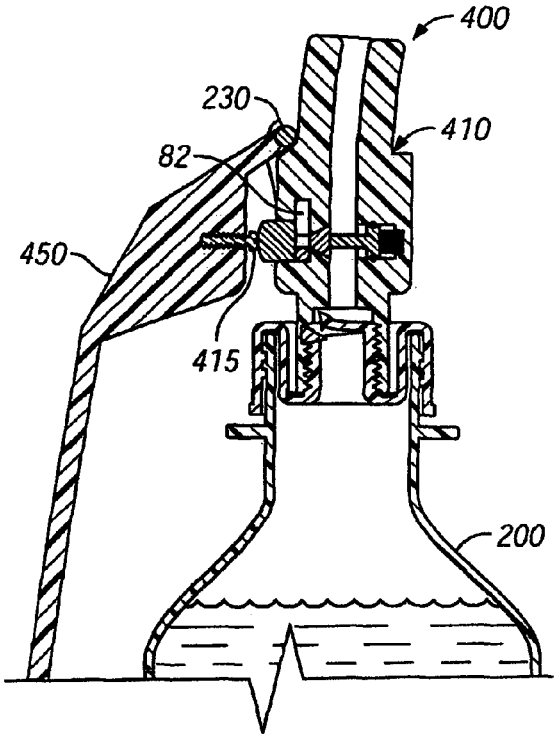
FIG. 4 is an exploded cross-sectional side view of the device connected to the beverage container in an upright position with the addition of the lever.
Figure 5:
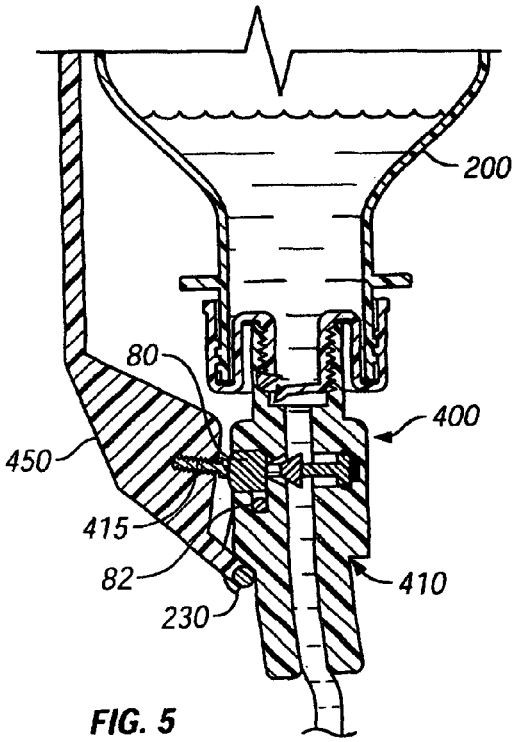
FIG. 5 is an exploded cross-sectional side view of the device connected to the beverage container in a pouring position with the addition of the lever.

Referring to FIG. 4, container (200) is shown in an upright storage position while FIG. 5 shows container (200) in a pouring position. Bolt member (415), a type of actuator, is perpendicularly connected to the uppermost section of lever (450) at a position aligned directly above the button mechanism (80). The bolt member (415) protrudes outward to a desired height which is adjustable by the user. As illustrated, bolt member (415) can be adjustably screwed into the upper end of lever (450) until the desired height is obtained.

As shown in FIG. 3, handle (420) is connected to the distal end of lever (450). Handle (420) can have grooves to support the hand. In use, the user depresses handle (420) which in turns depresses the lever (450) which cause bolt member (415) to contact and depress button mechanism (80).

In some embodiments, the length of handle (420) can be adjusted. As shown in FIG. 3, rod (250) is attached to the distal end of lever (450). Handle (420) is adapted to adjustably connect to rod (250) to a desired length. In use, handle (420) is adjusted to accommodate the size of the container (i.e. 20 oz, 2, Liter, or 3 liter or etc.) as well as the size of the user's hand.

Locking mechanism (82) (illustrated in FIGS. 4 and 5) can operate in conjunction with lever (450) and handle (420). Handle (420) can only depress lever (450) while container (200) is in a pouring position, as shown in FIG. 5. Additionally, the entire lever (450) can be removable attached to the pouring spout through hooking mechanism (230). As depicted, hooking mechanism (230) is externally mounted abutting step portion (410) of pouring spout (400).

Figure 6:
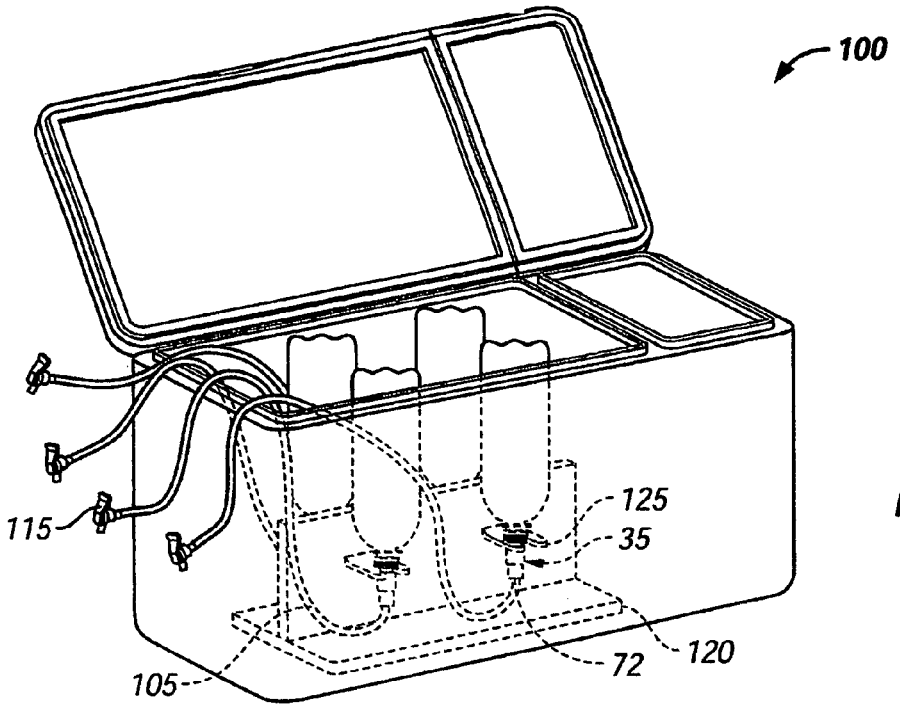
FIG. 6 illustrates an alternative embodiment of the present invention stored in a cooler with each beverage container connected to a separate pouring spout valve.
Figure 7:
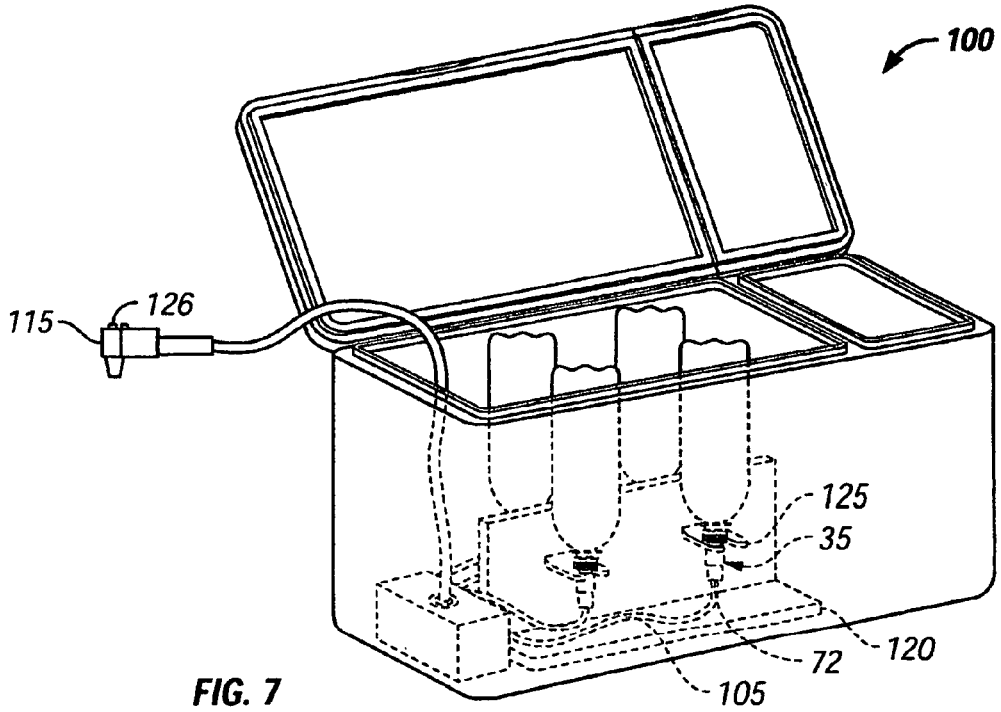
FIG. 7 illustrates an alternative embodiment of the present invention stored in a cooler with each beverage container connected to a separate pouring spout valve.

Referring to FIGS. 6 and 7, there is shown an alternative dispensing mechanism (100). In this alternative embodiment, an elongated pipe (105) interconnects the outlet port (72) of each connector member (35) to a dispensing valve (115). Elongated pipe (105) is operationally connected to dispensing valve (15) in a conventional manner. Dispensing valve (115) provides the capability of controlling the dispensing the beverage from the container.

In this embodiment, dispensing mechanism (100) can support the dispensing of beverage from a plurality of containers with each container containing a different type of carbonated beverage. To support the configuration of dispensing from a plurality of containers, stand (120) is required to securely hold at least one beverage container in an upside down position. In the illustrated embodiment in FIGS. 6 and 7, one type of stand (120) is illustrated. Stand (120) further comprises a bottom panel with a second panel perpendicularly attached near the center of the bottom panel. The second panel extends vertically upward therefrom to a set distance which allows stand (100) to fit into a cooler. Stand (120) further includes a plurality of container holders (125) mounted to the upper end of the second panel. Each container holder has the means for securely holding the upper end of the beverage container in an upside down position.

FIGS. 6 and 7 illustrate two alternative means of dispensing from a plurality of containers. In FIG. 6, each beverage container is connected to a separate dispensing valve (115) (i.e. a conventional pouring spout). However, as shown in FIG. 7, each container can be connected to a single dispensing valve (115). With this configuration, the dispensing valve (115) has a separate means (i.e. a separate button (126)) to control the dispensing of beverage from each connected container.

Additionally, the dispensing mechanism (100) can be adapted to be stored in a cooler, refrigerator or another suitable refrigeration mechanism. As shown in FIGS. 6 and 7, the height of stand (120) is adjusted to allow the stand (120) to fit in a cooler or another type of refrigeration unit.

Figure 8:
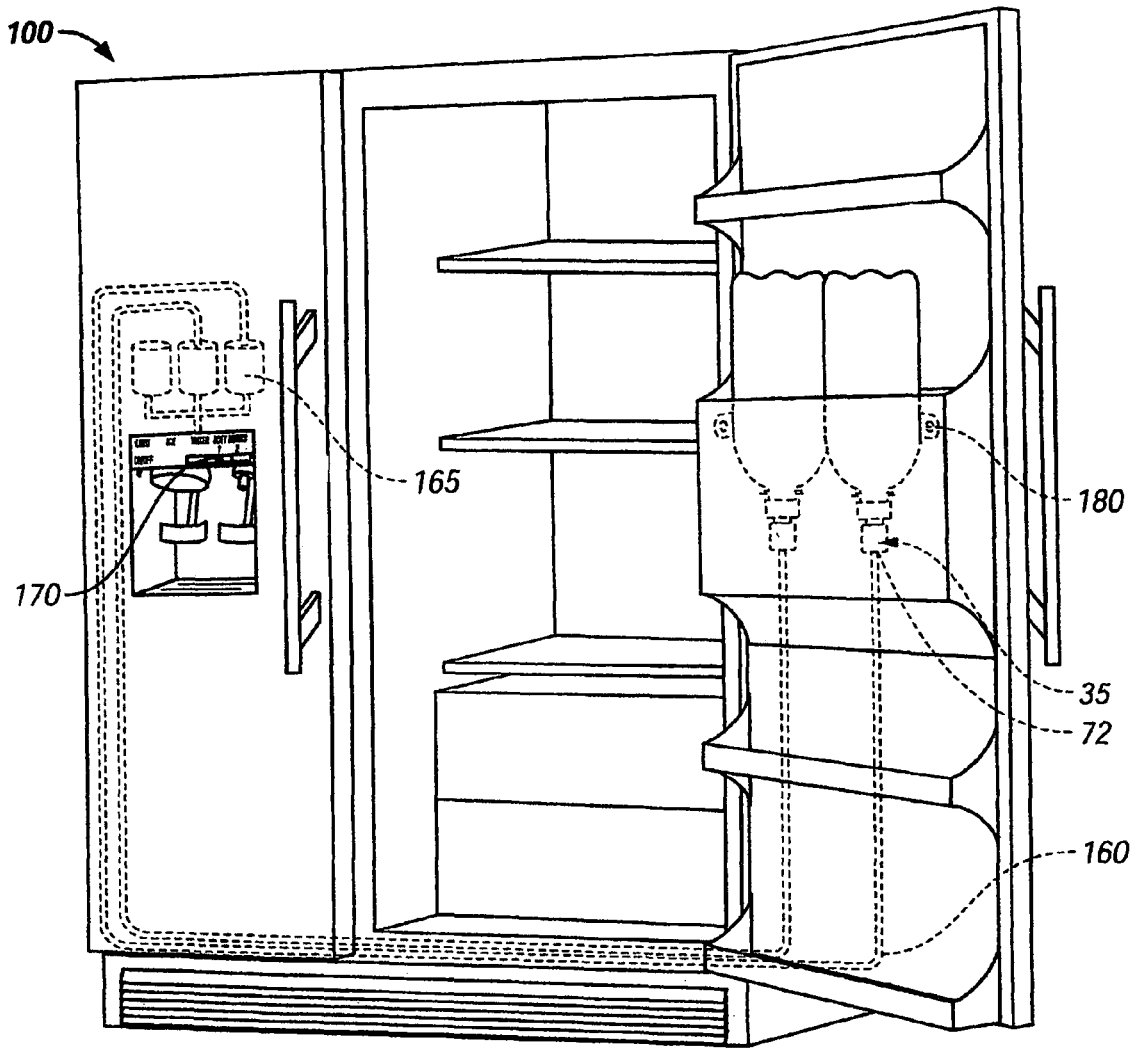
FIG. 8 illustrates an alternative embodiment of the present invention incorporated into a refrigerator.
Figure 9A:
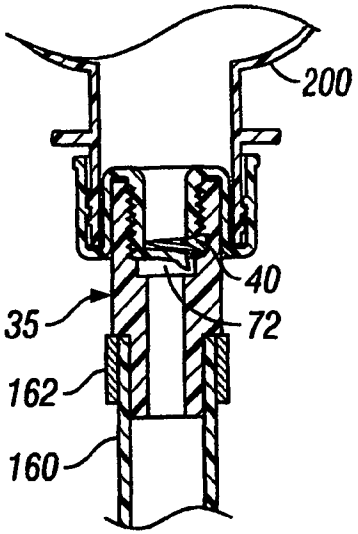
FIG. 9A is an exploded view of the connection between the connector member and the elongated pipe in the refrigerator embodiment.
Figure 9:
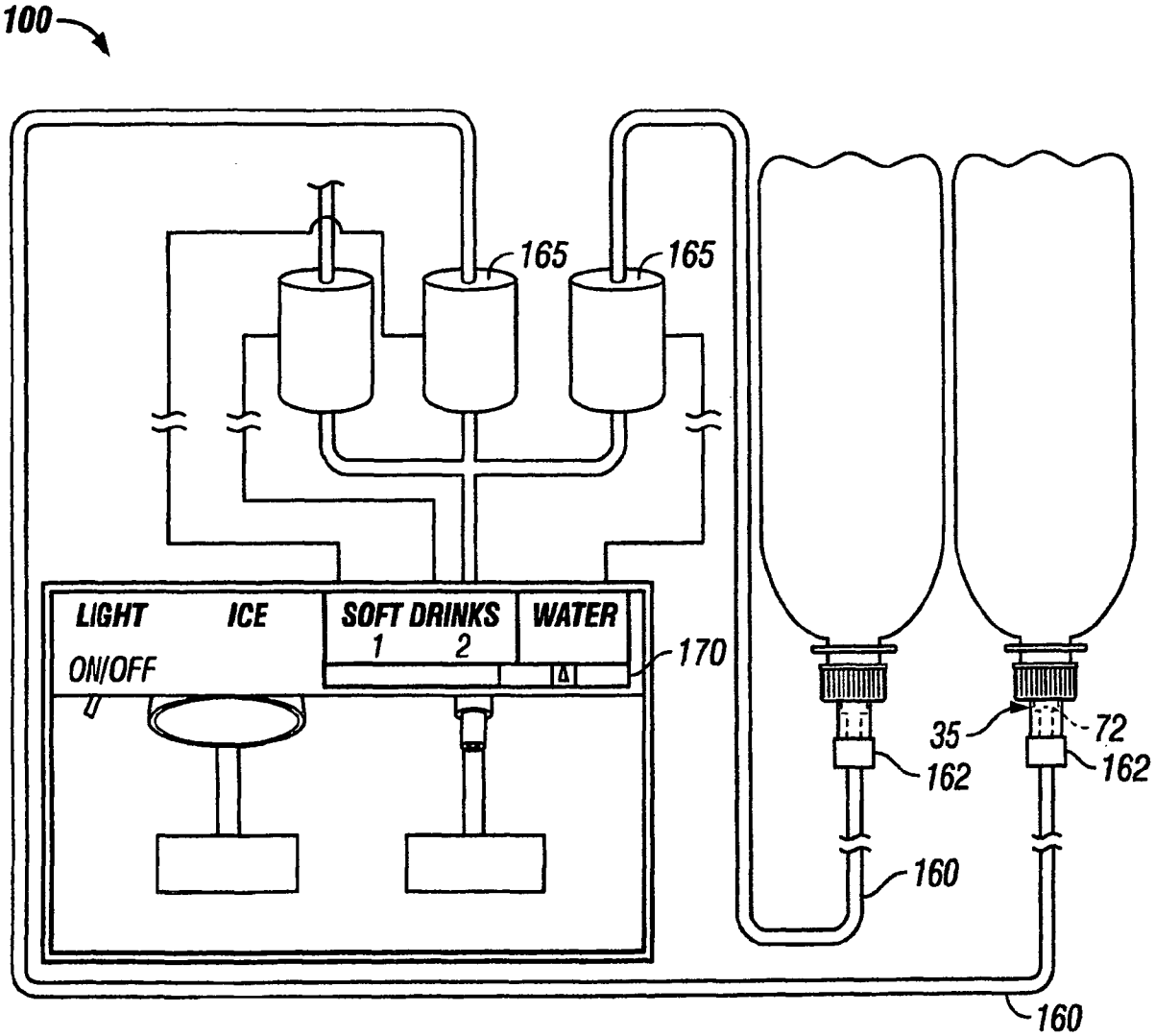
FIG. 9 is an exploded view of the present invention illustrating each beverage container connected to the solenoid valve in the refrigerator.

Referring to FIGS. 8, 9 and 9A, there is shown an alternative dispensing mechanism (100) incorporated into a refrigerator. In this alternative embodiment, an elongated pipe (160) interconnects outlet port (72) of each connector member (35) to a solenoid valve (165). Elongated pipe (160) is operationally connected to solenoid valve (165) in a conventional manner. As shown, the user can then selectively control the initiation and termination of dispensing the beverage through a conventional switch (170).

Referring to FIG. 9A, there is shown an exploded view of the connection between connector member (35) and elongated pipe (160). Pipe member (160) is adapted to be inserted into connecting member (35). Then a fastener (162) (i.e. such as a clamp) is utilized to secure the two together.

As shown in FIG. 8, stand (180) is required to securely hold the containers in an upside down position. As shown the stand (180) can be incorporated within the shelves of the door of a refrigerator. The configuration of the stand (180) utilized in the present invention is not limited to the configuration illustrated in FIG. 8. Additionally, the configuration of the stand (120) utilized in the present invention is not limited to the configuration illustrated in FIGS. 6 and 8. The retaining device shown in FIGS. 10, 10A, 11 and 11A can be incorporated onto the devices shown in FIGS. 6, 7, 8, 9, and 9A.

What is claimed is:

1. A carbonation retaining closure assembly device for a beverage container, the device assembly comprising: a cap member manufactured to operationally engage with the manufactured cap engaged upon the mouth of the beverage container; the cap member having a top portion that is operationally coupled to a connector member; a cutting mechanism mounted upon the connector member wherein a slit is punctured within an outer wall of the manufactured cap as the connector member is engaged with the top portion of the cap member; a dispensing mechanism operationally connected to the connector member for dispensing the beverage through the dispensing mechanism; a handle with a CO2 container integrally incorporated therein is operationally coupled to the dispensing mechanism; and a passageway disposed between the CO2 container and through the dispensing mechanism extending through the connector member and into the cap member into the mouth of the beverage container such that when the handle is depressed CO2 is dispersed through the passageway into the beverage container thereby maintaining a predetermined carbonation level within the beverage container.

2. The device of claim 1 wherein the dispensing mechanism further comprises: an outlet port formed within a lower end of the dispensing mechanism; a pouring spout being formed upon the outlet port and extending vertically upward to a top end; an internal bore extending from the outlet port to the top end; a control valve operationally coupled to the outlet port, the control valve having a movable valve element for opening and closing the outlet port; and a button mechanism coupled to the movable valve element for selectively initiating and terminating the dispensing of the beverage through the outlet port.

3. The device assembly of claim 2 further comprising a locking mechanism coupled to the button mechanism for preventing the operation of the button mechanism while the container is in an upright storage position.

4. The device assembly of claim 2 further comprising an actuator operationally associated with the handle wherein the depression of the handle causes the actuator to initiate the operation of the button mechanism allowing the CO2 to flow into the passageway through and into the beverage container.

5. The device assembly of claim 1 wherein the handle further comprises a communication port operationally coupled to the handle for insertion of CO2 into the container disposed therein.

6. A carbonation retaining closure assembly device for a beverage container, the device assembly comprising: a cap member manufactured to operationally engage with the mouth of the beverage container; a dispensing mechanism operationally connected to the cap member for dispensing the beverage through the dispensing mechanism; a handle with a CO2 container integrally incorporated therein is operationally coupled to the dispensing mechanism; and a passageway disposed between the CO2 container and through the dispensing mechanism and into the cap member into the mouth of the beverage container such that when the handle is depressed CO2 is dispersed through the passageway into the beverage container thereby maintaining a predetermined carbonation level within the beverage container.

7. The device of claim 6 wherein the dispensing mechanism further comprises: an outlet port formed within a lower end of the dispensing mechanism; a pouring spout being formed upon the outlet port and extending vertically upward to a top end; an internal bore extending from the outlet port to the top end; a control valve operationally coupled to the outlet port, the control valve having a movable valve element for opening and closing the outlet port; and a button mechanism coupled to the movable valve element for selectively initiating and terminating the dispensing of the beverage through the outlet port.

8. The device assembly of claim 7 further comprising a locking mechanism coupled to the button mechanism for preventing the operation of the button mechanism while the container is in an upright storage position.

9. The device assembly of claim 7 further comprises an actuator operationally associated with the handle wherein the depression of the handle causes the actuator to initiate the operation of the button mechanism allowing the CO2 to flow into the passageway through and into the beverage container.

10. The device assembly of claim 6 wherein the handle further comprises a communication port operationally coupled to the handle for insertion of CO2 into the container disposed therein.

* * * * *